US005414883A

United States Patent [19]

Fangrow, Jr.

[11] Patent Number: 5,414,883

[45] Date of Patent: May 16, 1995

[54] BACKBOARD

[75] Inventor: Thomas F. Fangrow, Jr., Mission Viejo, Calif.

[73] Assignee: Life Support Products, Inc., St. Louis, Mo.

[21] Appl. No.: 152,586

[22] Filed: Nov. 15, 1993

[51] Int. Cl.[6] ..... A61G 1/00

[52] U.S. Cl. ..... 5/625; 5/628; 128/870

[58] Field of Search ..... 5/625–629; 128/870

[56] References Cited

U.S. PATENT DOCUMENTS

| | | | |
|---|---|---|---|
| 3,611,454 | 10/1971 | Klippel | 5/625 |
| 4,183,110 | 1/1980 | Kidd et al. | 5/629 |
| 4,347,635 | 9/1982 | Eisenhauer | 5/626 X |
| 4,473,912 | 10/1984 | Scheidel et al. | 5/625 X |
| 4,506,664 | 3/1985 | Brault | 128/370 |

FOREIGN PATENT DOCUMENTS

| | | | |
|---|---|---|---|
| 2526672 | 1/1938 | European Pat. Off. | 5/628 |
| 2182570 | 5/1987 | United Kingdom | 5/625 |

OTHER PUBLICATIONS

Copy of p. 52 illustrating the use of wooden backboards, JEMS Magazine, Nov. 1993.

Copy of p. 68 advertising the Pro-Lite spineboard, JEMS Magazine, Nov. 1993.

Copy of advertisement for Ferno backboard, JEMS Magazine, Nov. 1993.

Copy of pages advertising Dyna-Lite spineboard, DYNA-MED Catalog 1030, Spring 1994.

*Primary Examiner*—Trettel: Michael F.

*Attorney, Agent, or Firm*—Knobbe, Martens, Olson & Bear

[57] ABSTRACT

Disclosed is a backboard for use by paramedics and the like constructed of a hollow plastic shell with supporting beams extending substantially its length. The beams are encapsulated within hollow ribs extending along the bottom of the shell with several spacers and plugs to help position the beams. The beams provide rigidity to the backboard in the primary load bearing direction.

20 Claims, 5 Drawing Sheets

14
1
10
12
10
2

16
2
4
16

6
4
2
6

14
6

9
1
14
16
74
16
12
11
4
6
6
10
70
8

BACKBOARD

FIELD OF THE INVENTION

This invention relates to an apparatus for supporting and transporting an injured person and relates more particularly to a board for supporting an injured person in a manner to immobilize or prevent damage to the person's spinal column.

BACKGROUND OF THE INVENTION

Many different types of backboards are used by paramedics and other rescue personnel to transport an injured person while trying to minimize the risk of further injury, particularly with respect to the spinal column. Perhaps the oldest and yet the most commonly used device is a simple wooden board in the shape of a person with hand and strap openings on the sides of the board and with a pair of spaced elongated supports attached to the lower side of the board. These supports raise the board so that it is easier for a person to place hands in the openings while lifting the board and the patient. The supports also add rigidity to the structure so as to minimize the risk of bending or deflection of the board that might cause trauma to the patient. Wooden boards are advantageous because they are currently the least expensive, but the boards are subjected to considerable abuse with the result that wooden boards wear and splinter on edges that can be a hazard. Also, as they become worn, wooden boards absorb bodily fluids, and hence may become unsanitary or difficult to clean.

Another backboard currently being marketed is made of plastic, the outer shell being formed by a rotational mold technique and then filled with plastic foam. Such a board may be more durable than wood and is certainly easier to clean, but there are some disadvantages. In addition to the time required for the actual molding of a single board, considerable hand labor is required in the removal of flashing arising during the molding operation. Further, extensive hand labor of this type can cause hand stress difficulties. As a result, this plastic board is considerably more expensive than wooden boards. Another major disadvantage is that the board is not as rigid as the wooden boards in that the plastic foam formed within the outer plastic shell is somewhat compressible and is not very resilient. Circular cross-sectioned fiberglass rods inserted in the board help rigidity somewhat, but they are not situated to receive the load directly from the shell. Instead, the load is transmitted through the compressed foam.

In view of the foregoing, a need exists for a backboard that is at least as rigid as wood, is more durable and cleanable than wood, but is no more expensive than wood. Storage compartments that are commonly found on fire trucks and other vehicles used by rescue personnel are designed to receive two wooden boards that are nested together to create a rather thin package. Thus, replacement boards should be adapted to have a configuration similar to that of wooden boards.

SUMMARY OF THE INVENTION

In accordance with the invention, a backboard is provided in the form of a hollow plastic shell having an exterior shape substantially like that of the commonly used wooden boards. In a preferred form of the invention, such a shell is made of high-density polyethylene plastic by blow molding. The patient side of the shell is essentially smooth while the lower or back side has a pair of spaced ribs extending substantially throughout the length of the shell. An elongated beam is positioned within each rib, each beam preferably having a thin substantially rectangular cross section with the longer dimension of the cross section extending between the patient wall of the shell and the lower surface of a rib. Thus, the patient load on the board is substantially transmitted to and borne by the reinforcing beams which are very rigid in the primary load bearing direction.

Preferably the beams are made of fiberglass and resin or other strong composite material. In addition to being strong, fiberglass is desirable from the standpoint that it is somewhat resilient so that if the load on the board is so great as to cause it to flex slightly, the beams would restore the board to its normal undeflected position when the load is removed.

A major advantage of the board of this type is that it is durable and easy to clean and it is also relatively inexpensive in view of the use of blow molding. An individual shell can be blow-molded in no more than two minutes, which is much faster than rotation molding; and the blow molding apparatus includes means for automatically removing flashing, such that time-consuming and expensive labor operations are not needed.

To provide the desired strength, it is not necessary to completely fill the ribs in the shell with a fiberglass beam; but to provide lateral stability to the beam within the rib, it is desirable to employ spacers for the beams. The spacers are preferably glued to the beam and engage the inner walls of the hollow rib as well as the inner surface of the patient shell wall. Preferably, a spacer is positioned on each end of the beam and at least one spacer is located between the beam ends. The end spacers also help capture the beam lengthwise within the shell. In one form of the invention, the beams are inserted endwise through an opening in an end wall of the ribs, and an end plug is adapted to capture the beam within the rib. An end spacer is also provided to close the opening into the hollow rib.

DETAILED DESCRIPTION OF THE INVENTION

Figure 6:
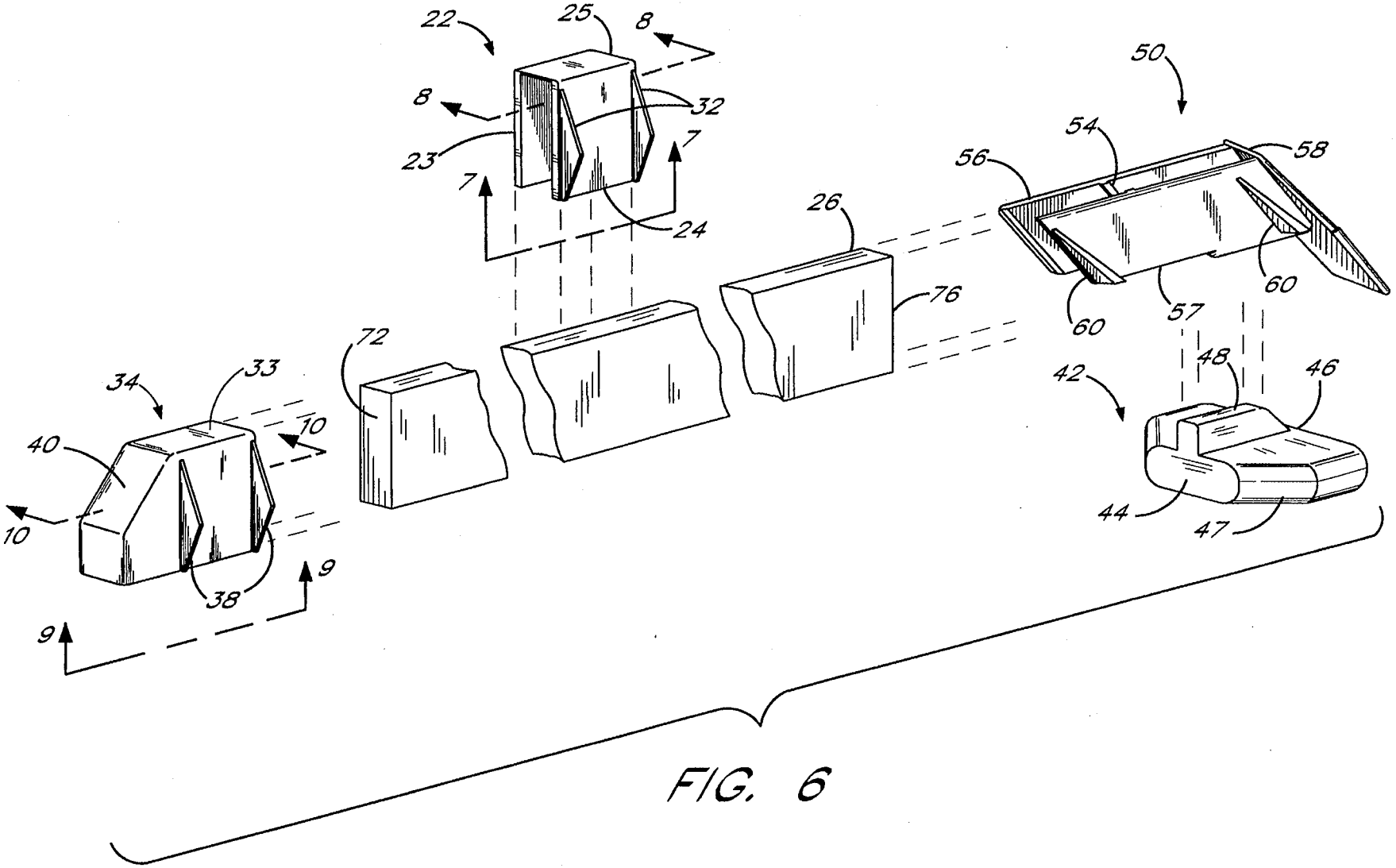
FIG. 6 is an exploded perspective view of a beam showing various spacers and plugs relative thereto.

FIGS. 1–5 illustrate an elongated backboard 1 having a relatively planar configuration. The top surface of the top wall 2 is substantially smooth and the bottom surface of the bottom wall 4 is also substantially smooth with the exception that two elongated ribs 6 extend substantially the length of the backboard. A rigidifying beam 26, as shown in FIG. 6, is placed in each of the two ribs 6 to provide support. The two ribs 6 and the two associated beams 26 advantageously extend substantially the length of the backboard to provide rigidity and to prevent bending due to loading of the backboard.

In the preferred embodiment, the two ribs 6 are spaced relatively equal in distance from the center of the backboard and are substantially equal in length so that the loads bearing on the backboard 1 are distributed substantially evenly to each of the two beams 26. In the preferred embodiment, the ribs 6 are spaced slightly farther from center at the head end 8 of the backboard than at the foot end 9. Although the preferred embodiment utilizes two ribs, additional or fewer ribs and beams of different lengths can also be used and strategically placed to stiffen the backboard.

Figures 1, 2, 3, 4, 5:
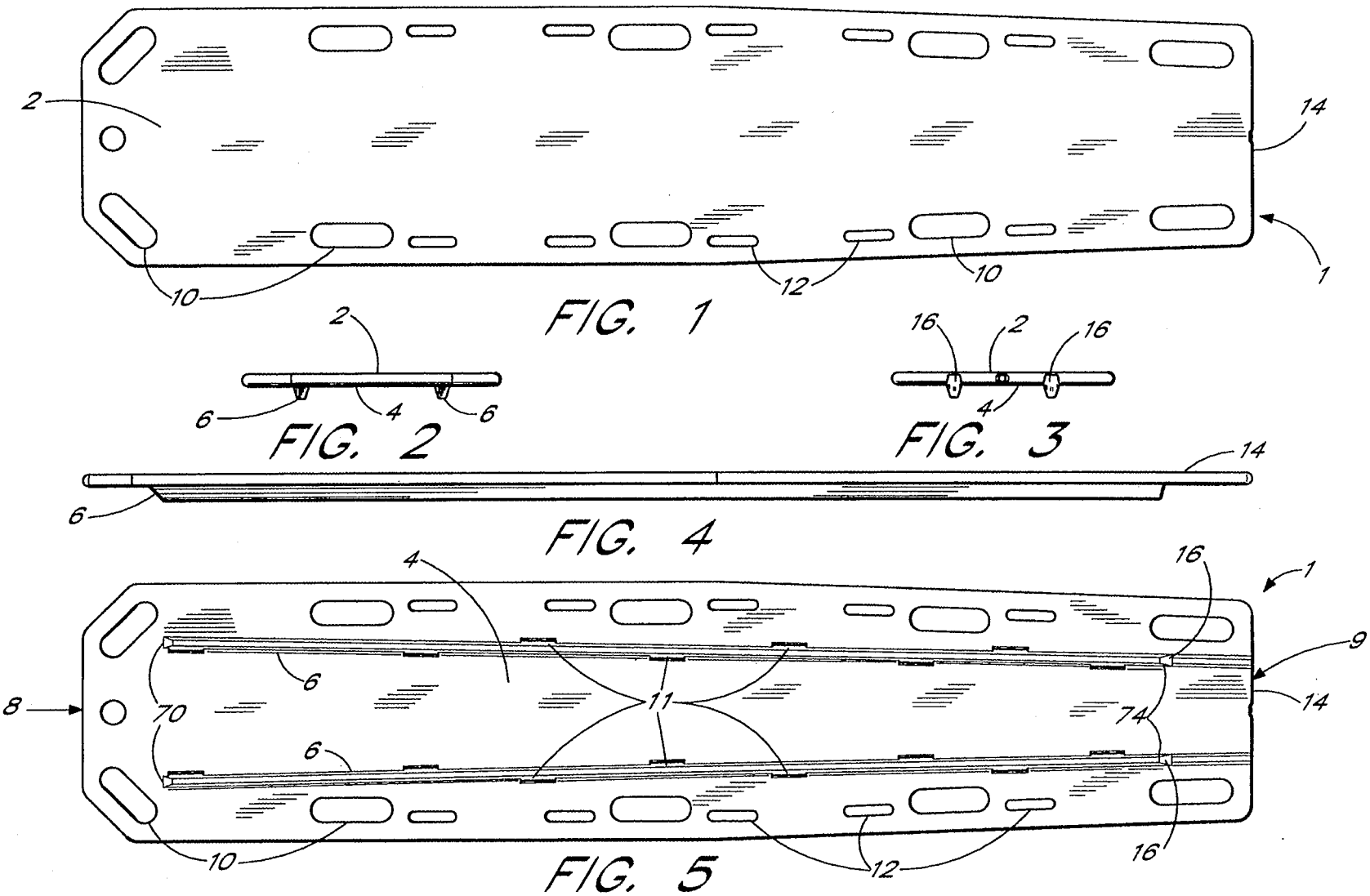
FIG. 1 is a top plan view of the backboard of the present invention.
FIG. 2 is a front end elevational view of the backboard.
FIG. 3 is a rear end elevational view of the backboard showing the rib openings.
FIG. 4 is a side elevational view of the backboard.
FIG. 5 is a bottom plan view of the backboard.

As can be seen in FIG. 1, several openings 10 are provided along the edge of the backboard for easier handling by paramedics and the like. Several smaller holes 12 are also provided so that straps (not shown) can be secured to the backboard and around the patient. Straps may be needed when the patient must be secured to the backboard during lifting such as when a patient must be carried a long distance or up or down a hill. Straps are also used when the patient has a back injury so that the patient can be secured firmly to the backboard to prevent unwanted movement.

The backboard 1 is preferably a molded, hollow, plastic shell 14 having an exterior shape which is substantially like that of commonly used wooden boards. The outside configuration of the backboard may be rectangular, but preferably is matched generally to the profile of an average adult with the head and shoulder end 8 being slightly wider than the leg and foot end 9. Backboards of different sizes to accommodate children can of course be provided.

In the preferred embodiment, the backboard 1 is about 12 inches wide at the foot end 9, 16 inches wide at the head end 8, and five to six feet long. The backboard is also $\frac{3}{4}$ inches in depth between the top wall 2 and the bottom wall 4, but is approximately $1\frac{1}{2}''$ to $2''$ in depth along the ribs 6.

In the preferred embodiment, the backboard shell 14 is made of high density polyethylene plastic although other high strength similar materials can be used. The material used advantageously permits x-rays to be taken of the patient while still strapped to the backboard, unlike previous metal frame structures. The rigidifying beams 26 are preferably made of fiberglass and resin or other strong composite material and are relatively thin so as not to interfere appreciably with x-rays.

Preferably, the hollow plastic shell 14 of the present invention is manufactured by a blow molding process, wherein plastic material is blown into a mold to form the hollow shell. One of the main advantages of blow molding is that it is relatively inexpensive to perform. Not only is blow molding a relatively quick procedure, which usually takes no more than two minutes to accomplish, blow molding apparatuses typically include a means for automatically removing flashing. Because blow molding is efficient and less time-consuming than other methods, the cost of labor is reduced.

Blow molding is a substantially faster process than rotational molding which is a technique that has been used in making a plastic backboard. Rotational molding also does not have a means for automatically removing the flashing that occurs during the molding operation. Therefore, applicant's present invention is less expensive to manufacture than such backboard.

Each rib 6 forms a hollow, elongated space between the inner surface of the top wall 2 of the shell 14 and the inner surface of the rib walls. The hollow space formed by each rib 6 also extends contiguously within the hollow space between the top wall 2 and the bottom wall 4 of the backboard.

Figure 11:
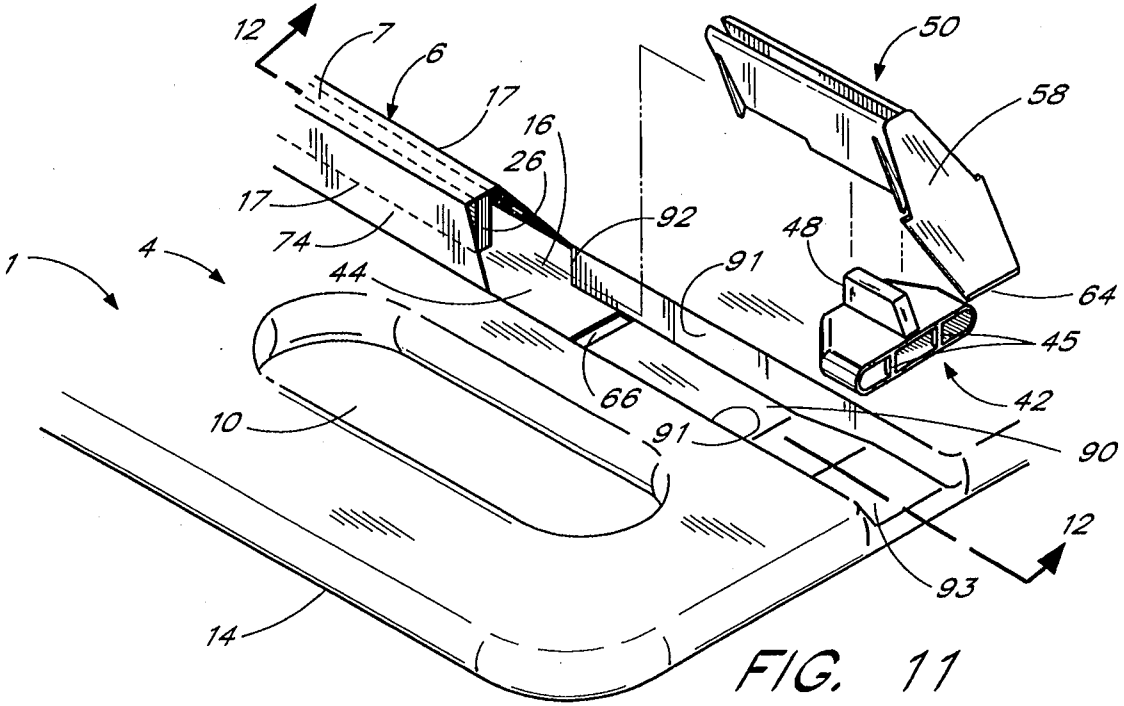
FIG. 11 is a perspective view of a bottom corner of the backboard showing one of the rib openings, a spacer and a plug.

In the preferred embodiment shown in FIG. 11, each rib 6 includes a bottom wall 7 which is elongated and substantially parallel to the top wall 2 of the backboard 1. Extending upward (or downward as shown in FIG. 11) at an obtuse angle from each bottom rib wall 7 are two side walls 17 extending between the bottom rib wall 7 and the bottom wall 4 of the backboard. The bottom wall 7 of each rib 6 is preferably about $\frac{3}{4}''$ wide, and is otherwise dimensioned to substantially support the width of each rigidifying beam 26. The side walls 17 spread outwardly to about $1\frac{1}{4}''$ wide at the bottom wall 4 of the backboard.

Each of the ribs 6 also has an opening 16 at the foot end of the rib 74, used to insert a rigidifying beam 26 endwise into each rib. In addition, located along either side of each rib, in alternating fashion, are rigidifying indentations 11, FIG. 5. The indentations are preferably substantially rectangular in shape and extend from the bottom wall 4 to the top wall 2 adjacent each rib 6 to provide rigidity along the side of each rib. The indentations 11 are located on either side of each rib in alternating fashion to form an intermittent and elongated, longitudinally oriented passageway between the top wall 2 and the bottom wall 7 of each rib through which a rigidifying beam 26 extends.

In the preferred embodiment, each rigidifying beam 26 is rectangular in cross section, although other cross-sectional shapes can be used. The preferred rigidifying beam has a vertical dimension of approximately $1\frac{1}{2}''$ to $2''$. This dimension is dictated by the vertical dimension of the hollow space between the top wall 2 of the backboard and the bottom wall 7 of the rib. Preferably, the vertical dimension of the rigidifying beam 26 matches the vertical dimension of the hollow space such that the rigidifying beam 26 fits relatively tightly within the hollow space. NOTE: Reference made to only one rib 6 or one beam 26 is intended to apply similarly to each rib and beam.

A critical aspect of the invention is that the beam is rigidly fixed with respect to the top shell wall 2 so that the top wall, and consequently the backboard, cannot flex with respect to the beam, and the beam adequately supports the top wall. This rigidity can be provided by the tight fit of the rigidifying beam 26 between the top shell wall 2 and the bottom rib wall 7 or can be provided by otherwise affixing the beam to the top wall 2 by glue or other means.

In addition, in the preferred embodiment, the vertical depth of the beam 26 is greater than its horizontal width. This is because the primary load bearing direction is vertical. The moment of inertia of the rigidifying beam must be greater in the vertical direction about a horizontal axis than in the horizontal direction about a vertical axis. Preferably, the rigidifying beam 26 is about ¼" wide.

The beams 26 provide adequate strength without completely filling the hollow width of the rib 6. In the preferred embodiment, the side walls 17 of the rib 6 are wider than the beam 26 and the walls taper towards each other in the depending direction. The narrow beam profile facilitates inserting the beam into the wider hollow rib through an opening 16 at one end. This is also important because the thickness and smoothness of the blow molded shell 14 cannot always be controlled by the blow molding process.

The hollow rib 6 also does not need to be tightly fitting about the side of the beam because there is no appreciable lateral edge load directed on the beam, even when the backboard is fully loaded. The only lateral stability required is resistance to buckling and twisting which are prevented by several spacers extending between the beam and the rib walls. The present invention utilizes unique spacer elements that conform to the side walls 17 of the rib 6 to provide lateral stability to the beam 26. Thus, even if the beam 26 does not fully engage the inner surface of the side walls 17 of the rib 6, the beam will not buckle or twist during use.

The beam 26 is stabilized within the rib 6 by several spacers 22, 34 and 50, which are preferably glued or otherwise secured to the beam, as shown in FIG. 6. The spacers are secured to the outside of the beam 26 and have outwardly extending fins, 32, 38 and 60, which engage the inside surface of the rib 6 to provide a relatively tight fit. This prevents the beam 26 within the rib 6 from buckling or twisting out of its primary load bearing orientation.

Each spacer has a beam conforming inner surface which mounts onto the beam. The spacers are formed from a plastic material much like the high density polyethylene material used to form the shell, although they can be made of any durable and moldable material. In the preferred embodiment, three spacers are used, one on each end of the beam and one in the center, although any number of spacers could also be used.

Figure 7:
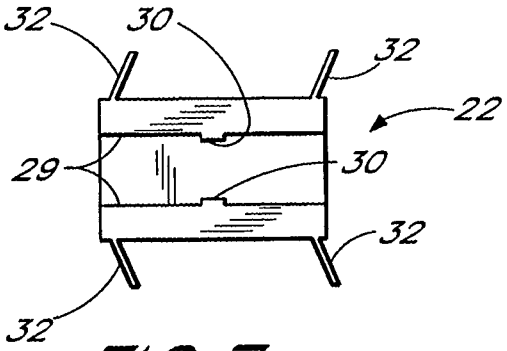
FIG. 7 is a bottom view of the center spacer.
Figure 8:
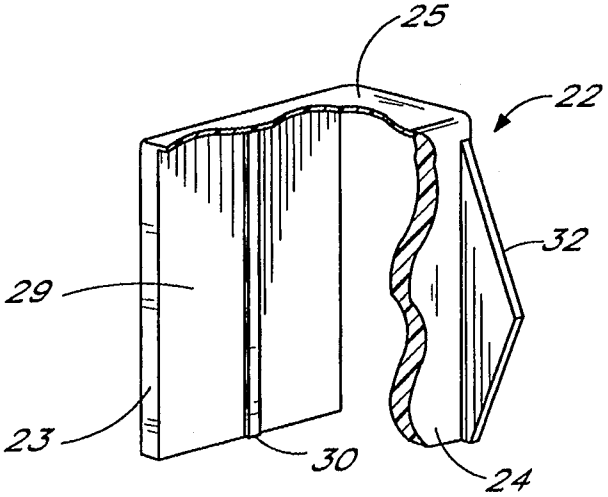
FIG. 8 is a cutaway perspective view of the center spacer.

As can be seen in FIGS. 6, 7 and 8, the center spacer 22 is configured much like a clip with two arms 23, 24 extending downwardly on either side, with the arms being connected by a very thin-walled center section 25. The center section 25 is made substantially thin such that it does not interfere with the tight fit between the rigidifying beam 26 and the inside surface of the rib 6. NOTE: The references made to downward and upward directions with respect to FIGS. 6–16 are in relation to the referenced figures, as opposed to being in relation to the top and bottom surfaces of the backboard shown in FIGS. 1–5. For ease of illustration, the beam shown in FIG. 6 and the other components shown in FIGS. 7–16 are actually upside down relative to the backboard. Thus, when reference is made to a center spacer having two arms extending downward, the same arms would extend upward in relation to the backboard as a whole.

The inner surface 29 of the center spacer 22, as seen in FIGS. 7 and 8, also has several ribs 30 which grip the beam. Due to manufacturing limitations, the inner surface 29 of the center spacer 22 will not always conform exactly with the outer surface of the beam. The center spacer 22 may be bonded, with glue or other adhesive, to the beam 26.

As shown in FIG. 7, on the outside of the arms 23, 24 are located several angled fins 32, which protrude from the main body of the spacer. The angled fins 32 help center the beam 26 within the side walls 17 of the rib 6 to provide lateral stability and prevent shifting of the beam within the shell. Each angled fin 32 has an edge that substantially conforms to the side walls 17 of the rib 6. In the preferred embodiment, the angled fins 32 are triangular in shape, with at least one edge extending at an obtuse angle so that it engages the inner surface of the side walls 17 of the rib which are also at an obtuse angle.

The angled fins 32 themselves are also advantageously oriented at an angle, as can be seen in FIG. 7, so that they can be easily inserted within the rib through the opening 16, despite unevenness in the thickness and inner surface of the rib walls. The angle permits the angled fins to bend rearward relative to the direction of the beam's insertion and adapt to the unevenness of the side walls 17 of the rib 6 while the beam is being slid into the rib. However, the angled fins 32 are stiff enough that they provide the necessary lateral stability.

Figure 9:
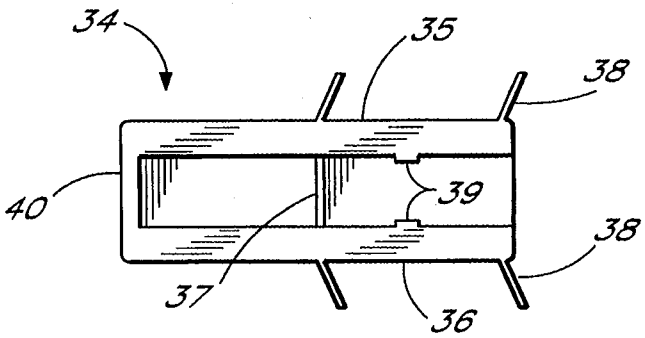
FIG. 9 is a bottom view of the head end spacer.
Figure 10:
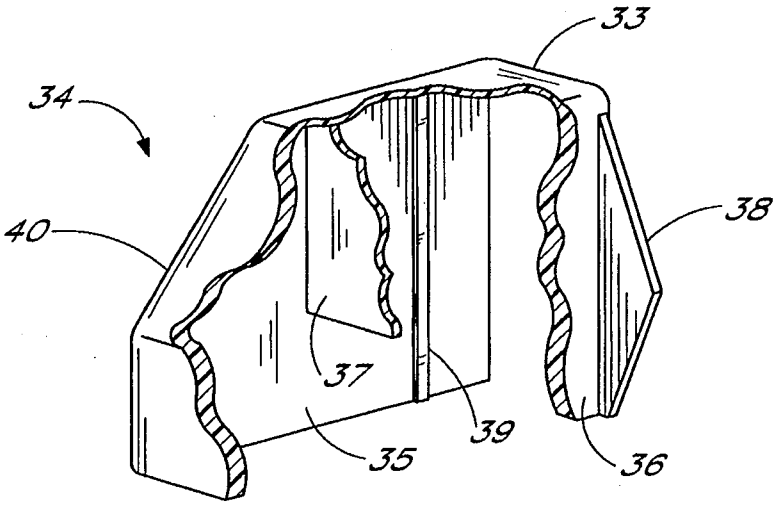
FIG. 10 is a cutaway perspective view of the head end spacer.

As seen in FIG. 6, at the head end of the beam 72, is a head end spacer 34 positioned on the beam 26. The head end spacer 34 may be glued or otherwise secured to the beam 26 prior to inserting the beam into the hollow rib 6. The head end spacer 34 has two spaced arms 35, 36 depending from a very thin center top section 33, as seen in FIGS. 9 and 10. The spacer includes a vertical plug section 37 and a forward wall 40 that conforms to the head end wall 70 of the rib 6. The plug section 37 abuts the beam 26, and the forward wall 40 abuts the head wall 70 of the rib 6. The head end wall 70 of the rib is angled at approximately a 45° angle and the forward wall 40 of the spacer 34 is similarly angled.

The contact between the head end spacer 34 and the head end wall 70 of the rib 6 maintains the beam within the shell and prevents the beam 26 from sliding forward. Also, if the board should be handled roughly and dropped on its head end 8, the head end spacer 34 will distribute any momentum load from the beam and prevent the rigidifying beam from puncturing the head end wall 70 of the rib 6. The 45° angle also helps distribute vertical loads from the rigidifying beam 26 to the rib 6, and consequently to the backboard.

As shown in FIG. 9, the head end spacer 34 also has several angled fins 38 to provide lateral stability to the beam and to accommodate various imperfections in the side walls 17 of the rib 6. The angled fins 38 also center the beam within the rib 6 at the head end 70 and prevent unwanted shifting during use. The spacer 34 also has several gripping ribs 39 which conform to the outside surface of the beam, much like the gripping ribs 30 of the center spacer 22.

At the foot end 74 of the rib 6, an opening 16, through which the beam 26 is inserted, is provided, as shown in FIG. 11. In the preferred embodiment, the opening 16 is generally hexagonal in shape as shown in FIG. 11. An indented slot 90 is formed in the shell 14 to permit the beam 26 to be slid through the opening 16 and into the hollow space formed by the rib 6 without being interfered with. The indented slot 90 extends longitudinally from the opening 16 rearwardly toward the foot end 9 and has a flattened portion that is flush with the top wall 2. At the reardward-most end is a raised portion 93 which provides structural support and rigidity to the foot end 9 of the backboard. The indented slot 90 has two side walls 91 on either side extending between the top wall 2 and the bottom wall 4.

Figure 12:
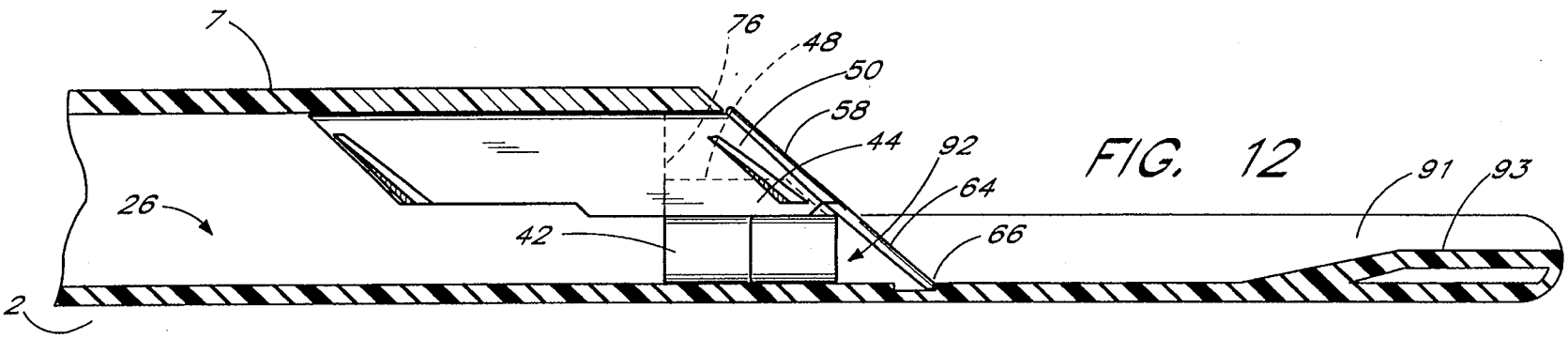
FIG. 12 is a sectional view taken along line 12—12 of FIG. 11.

Once the beam 26 is inserted into the hollow rib 6, an additional plug 42 is inserted into the opening 16, as diagrammatically shown in FIGS. 11 and 12. The plug 42 is wider than the rib opening 16, as seen in FIG. 11, but is relatively narrow in the fore and aft direction so that it can be easily inserted sideways into the opening 16 and then twisted into a locked position within a cavity 44 of the shell 14. The cavity 44 edge walls 92 confine the plug 42 and prevent it from shifting backward relative to the beam 26 and help maintain the beam lengthwise in the hollow rib 6.

Figure 15:
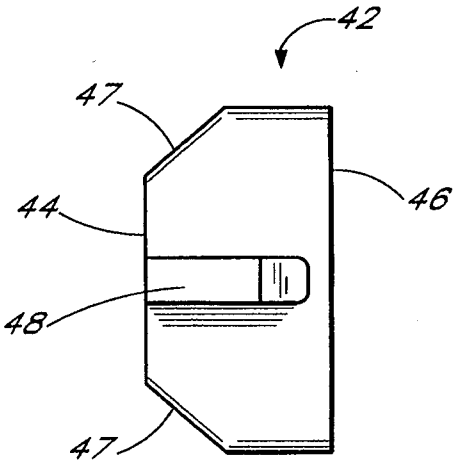
FIG. 15 is a top view of the spacer plug.
Figure 16:
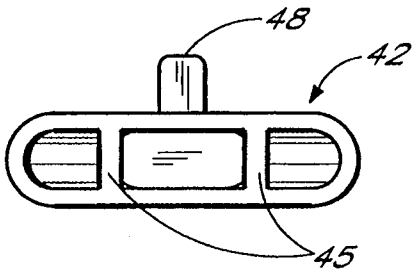
FIG. 16 is a rear view of the spacer plug.
Figure 13:
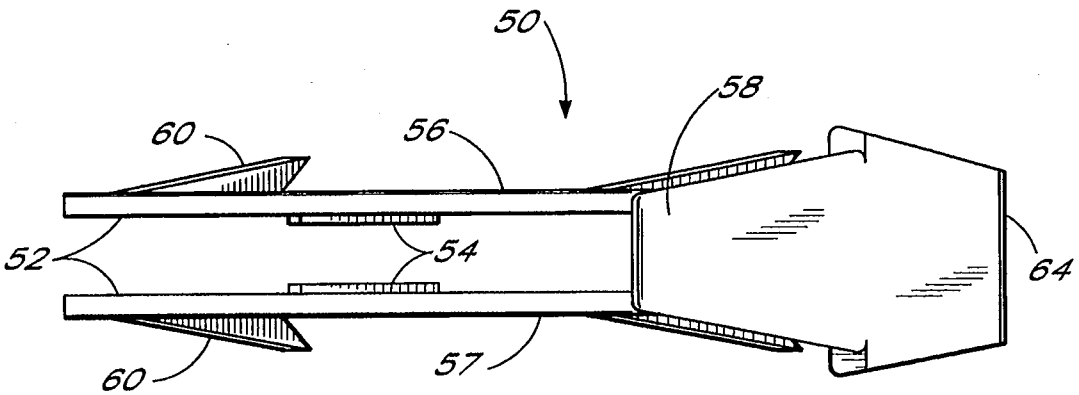
FIG. 13 is a top plan view of the foot end spacer.
Figure 14:
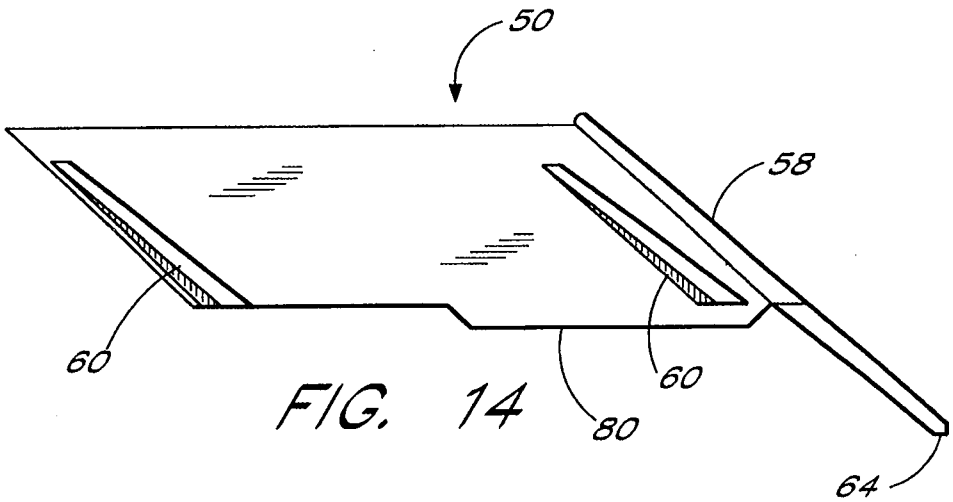
FIG. 14 is a side elevational view of the foot end spacer.

As can be seen in FIGS. 15 and 16, the plug 42 has a flat forward portion 44 which abuts the foot end 76 of the beam 26, and a flat rearward portion 46 which engages the cavity 44 walls of the shell 14 adjacent the opening 16, which also serves as the forward edge 92 of the side walls 91 of the indented slot 90. Retaining walls 45 are positioned along the rearward portion 46 to abut the forward edge 92 and prevent the edge 92 from digging into the plug 42. The plug 42 also has an upwardly protruding rib 48 rising above its center, which is substantially the same width as the beam 26. The plug is also angled on either side 47 of the forward portion 44 so as to permit the plug to be rotated within the cavity 44 adjacent the beam without interfering with the beam.

Once the plug 42 is positioned against the foot end 76 of the beam 26 and within the cavity 44 of the shell, an additional foot end spacer 50 is inserted into the opening 16. The foot end spacer 50 is positioned in the cavity 44 immediately above the plug 42 and adjacent the foot end 76 of the beam 26. The spacer 50 extends over the plug 42 and about the side of the beam 26.

The spacer 50 is an elongated member having two longitudinal arms 56, 57 extending from a center section 58 and spaced to fit about the sides of the beam 26. Unlike the center spacer 22, the center section 58 of the foot end spacer 50 is positioned at the end of the rigidifying beam, rather than along the side. The shape of the center section 58 is also such that it conforms to the outside edge of the opening 16. The bottom portion of the section 58 is slightly wider and flatter than the top portion so that it conforms to the side walls 91 of the indented slot 90.

The center section 58 has an outside surface that extends downwardly and forwardly at about a 45° angle from the extending arms 56 and 57. This is so that the center section 58 can be used as a plug over the opening 16, which has a similar 45° slant, to encapsulate and seal the beam 26 within the shell 14.

The foot end spacer 50 also has angled fins 60 that center the spacer within the rib 6 and conform to the side walls 17 of the rib. As with the other spacers, the angled fins 60 of the foot end spacer 50 help provide lateral stability to the beam. The foot end spacer 50 also has ribs 54 to engage the beam 26.

The arms 56, 57 of the foot end spacer 50 receive the protruding rib 48 of the plug 42 and the bottom edges 80 of the extending arms 56, 57 retain the plug 42 vertically in place. The plug 42 is otherwise maintained in the horizontal direction within the cavity 44 between the foot end 76 of the beam 26 and the edge 92 of the side walls 91 of the indented slot 90.

As seen in FIGS. 11 and 12, the center section 58 of the end spacer 50 has a tab 64 on its lower end that is adapted to fit into a shallow recess 66 located in the indented slot 90 of the shell. Once the spacer 50 is inserted into the opening 16, the wall 58 is aligned with the opening 16 such that the tab 64 extends into the recess 66. Once inserted, to secure the spacer 50 in place, the outside edge of the center section 58 is melted or otherwise secured to the periphery of the opening 16. By melting the plastic material, the foot end spacer 50 is sealed to the opening 16, securing the beam 26 in the shell 14. The opening 16 is also sealed to prevent dirt and fluids from entering the hollow shell 14.

The combination of the shell 14, ribs 6, beams 26, and the various spacers and plugs stabilize the beams 26 within the shell so that they support the backboard against deflection and loads. In particular, the beams 26 act as supporting joists spanning the length of the backboard. Any load which would deflect the backboard shell will be taken up by the supporting beams 26 so as to rigidify the backboard.

Although the invention is described in substantial detail, the present invention is not limited to the embodiments described. Other embodiments that function in the manner described herein are also contemplated.

I claim:

1. A backboard for supporting and transporting an injured person, comprising:

an elongated hollow shell sized to support a person lying thereon, said shell having an upper wall that is generally flat and a lower wall having at least one elongated, hollow rib depending from said lower wall and extending generally lengthwise on said shell; and an elongated rigid beam having a vertical dimension extending between said upper wall and a lower inner surface of said rib and extending substantially throughout the length of said rib, said beam being tightly positioned with respect to said shell upper wall and the rib lower inner wall in a manner such that a patient load on the upper surface of the backboard is transmitted directly to and born by said beam, said beam being substantially rigid in the primary load bearing direction in providing rigidity to said backboard.

2. The backboard of claim 1, wherein said beam has a generally rectangular cross section with a vertical dimension which is greater than a horizontal dimension.

3. A backboard for supporting and transporting an injured person, comprising:

a elongated hollow shell sized to support a person lying thereon, said shell having an upper wall that is generally flat and a lower wall having at least one elongated, hollow rib depending from the lower wall and extending generally lengthwise on said shell;

an elongated rigid beam having a vertical dimension extending between said upper wall and a lower inner surface of said rib and extending substantially throughout the length of said rib, said beam being tightly positioned with respect to said shell upper wall and the rib lower inner wall in a manner such that a patient load on the upper surface of the backboard is transmitted directly to and born by said beam, said beam being substantially rigid in the primary load bearing direction in providing rigidity to said backboard; and at least one spacer positioned on said beam to provide lateral stability to said beam.

4. The backboard of claim 3, wherein said spacers have extending arms which grip said beam.

5. The backboard of claim 4, wherein said arms have internal ribs that engage said beam.

6. The backboard of claim 3, wherein said spacers have angled fins that extend between the beam and side walls of said rib to provide lateral stability to said beam.

7. The backboard of claim 6, wherein said angled fins are slightly angled to permit said spacers to be easily inserted into said rib.

8. The backboard of claim 3, wherein one of said spacers is positioned proximate the center of the beam to provide lateral stability to said beam.

9. A backboard for supporting and transporting an injured person, comprising:

an elongated hollow shell sized to support a person lying thereon, said shell having an upper wall that is generally flat and a lower wall having at least one elongated rib extending generally lengthwise on said shell;

an elongated beam adjacent to said rib extending substantially throughout the length of each rib, said beam being positioned with respect to said shell in a manner such that a patient load on the upper surface of the backboard is substantially transmitting to and borne by said beam, said beam being substantially rigid in the primarily load bearing direction and providing rigidity to said backboard, said beam being made of fiberglass and resin.

10. The backboard of claim 9, wherein said beam extends between and substantially fills a vertical space between said shell upper wall and said rib.

11. The backboard of claim 9, wherein said beam is positioned within said shell and said rib, and includes an opening at one end through which said beam may be inserted.

12. The backboard of claim 11, including a plug for securing said beam within said rib.

13. A backboard for supporting and transporting an injured person, comprising:

a elongated hollow shell sized to support a person lying thereon, said shell having an upper wall that is generally flat and a lower wall having at least one elongated, hollow rib depending from the lower wall and extending generally lengthwise on said shell;

an elongated rigid beam having a vertical dimension extending between said upper wall and a lower inner surface of said rib and extending substantially throughout the length of said rib, said beam being tightly positioned with respect to said shell upper wall and the rib lower inner wall in a manner such that a patient load on the upper surface of the backboard is transmitted directly to and born by said beam, said beam being substantially rigid in the primary load bearing direction in providing rigidity to said backboard; and a spacer provided at each end of said beam to prevent said beam from sliding lengthwise relatively to said rib.

14. The backboard of claim 13, wherein a plug member is positioned adjacent to one end of said beam to maintain said beam within said rib.

15. The backboard of claim 13, wherein one of said spacers at the end of said beam covers an opening at the end of said rib.

16. A backboard for supporting and transporting an injured person, comprising:

an elongated hollow shell of sufficient size to support a person lying thereon, said shell having an upper wall;

a pair of spaced elongated beams extending substantially lengthwise with respect to said shell, said beams being substantially rigid in the primary load bearing direction of said backboard and being fixed with respect to said upper walls so that the shell is substantially rigid in that direction and so that a patient load is substantially transmitted to and borne by said beams;

a pair of spaced, hollow elongated ribs depending from a lower wall of said hollow shell to house the lower portion of said elongated beams; and spacer elements on said beams to prevent said beams from shifting within said shell.

17. The backboard of claim 16, wherein said ribs have an internal lateral width considerably greater than the width of said beams and including means for providing lateral stability of said beams with respect to said ribs.

18. The backboard of claim 16, wherein said shell is made of a high density polyethylene plastic material.

19. The backboard of claim 16, wherein said beams are made of fiberglass and resin material.

20. The backboard of claim 16, wherein said beams are encapsulated in said shell and a plug is provided to maintain each of said beams within said shell.

* * * * *